US006591776B2

(12) United States Patent
Miyazaki

(10) Patent No.: US 6,591,776 B2
(45) Date of Patent: Jul. 15, 2003

(54) SEMI-SUBMERGENCE TYPE HYDROFOIL CRAFT

(76) Inventor: Kunio Miyazaki, Kyoei Bldg. 4F, Higashi-Ikebukuro 3-2-4, Toshima-ku, Tokyo (JP)

( * ) Notice: Subject to any disclaimer, the term of this patent is extended or adjusted under 35 U.S.C. 154(b) by 0 days.

(21) Appl. No.: 09/987,344

(22) Filed: Nov. 14, 2001

(65) Prior Publication Data

US 2003/0089292 A1 May 15, 2003

(51) Int. Cl.[7] ..... B63B 1/24
(52) U.S. Cl. ..... 114/274; 114/61.14
(58) Field of Search ..... 114/274, 151, 114/256, 61.12, 61.14, 61.15, 278; 440/38, 68

(56) References Cited

U.S. PATENT DOCUMENTS

| | | | | |
|---|---|---|---|---|
| 3,611,972 A | * 10/1971 | Duport | ..... | 114/151 |
| 4,981,099 A | 1/1991 | Holder | | |
| 5,645,008 A | 7/1997 | Loui | | |
| 6,213,042 B1 | 4/2001 | Delfosse | | |

FOREIGN PATENT DOCUMENTS

| | | | |
|---|---|---|---|
| DE | 3321163 A * 12/1984 | ..... | B63H/25/46 |
| FR | 1328724 5/1963 | | |
| GB | 829880 3/1960 | | |
| GB | 1133102 11/1968 | | |
| GB | 2241479 A * 9/1991 | ..... | B63H/11/00 |
| WO | WO 96/00164 1/1996 | | |

OTHER PUBLICATIONS

Communication dated Jun. 12, 2002, including European Search Report (4 pages).

* cited by examiner

*Primary Examiner*—Jesus D. Sotelo
(74) *Attorney, Agent, or Firm*—Shlesinger, Arkwright & Garvey LLP

(57) ABSTRACT

A hydrofoil craft using a novel propulsive system able to greatly reduce wave making resistance at a sailing time is provided. Therefore, a semi-submergence type hydrofoil craft has a craft main body having a water surface craft body located above the water surface at the sailing time, an underwater craft body located below the water surface, and one or plural struts vertically connecting these craft bodies. The above underwater craft body has a water suction port opened to suck water from a front face of the underwater craft body, a propeller for sending-out the sucked water backward, at least one water injection port opened to inject the water sent-out from the propeller backward, at least one water sending passage extending from the rear of the propeller to the at least one water injection port, and at least one pair of wings projected from both side faces of the underwater craft body.

15 Claims, 3 Drawing Sheets

SEMI-SUBMERGENCE TYPE HYDROFOIL CRAFT

BACKGROUND OF THE INVENTION

1. Field of the Invention

The present invention relates to a semi-submergence type hydrofoil craft.

2. Description of the Background Art

A conventional hydrofoil craft can sail at high speed by reducing water resistance by raising a water surface craft body upward from the water surface and sliding the water surface craft body on the water.

SUMMARY OF THE INVENTION

An object of the present invention is to provide a hydrofoil craft using a novel propulsive system able to greatly reduce wave making resistance at a sailing time.

To achieve the above object, a semi-submergence type hydrofoil craft of the present invention has the following construction.

(1) In a first embodiment mode of the present invention, the semi-submergence type hydrofoil craft has a craft main body having a water surface craft body located above the water surface at a sailing time, an underwater craft body located below the water surface, and one or plural struts vertically connecting said water surface craft body and said underwater craft body. The above underwater craft body has a water suction port opened to suck water from a front face of the underwater craft body; a propeller for sending-out the water sucked from said water suction port backward; at least one water injection port opened to inject the water sent-out from said propeller backward; at least one water sending passage extending from the rear of said propeller to said at least one water injection port; and at least one pair of wings projected from both side faces of said underwater craft body.

(2) In the above mode (1), it is preferable that the pair of said water injection ports is opened to both the side faces of said underwater craft body, and two water sending passages are extended to the respective water injection ports leftward and rightward.

(3) In the above mode (2), it is preferable that said water injection ports are arranged below said wings on the side faces of said underwater craft body.

(4) In one of the above modes (1) to (3), it is preferable that said water suction port is formed such that said water suction port is gradually reduced in section from its opening in a backward direction.

(5) In one of the above modes (1) to (4), it is preferable that a rotatable flap attached to a rear end portion of said wing is arranged.

(6) In one of the above modes (1) to (5), it is preferable that said wing is constructed by a main wing and an aileron arranged in forward and backward directions.

(7) In one of the above modes (1) to (6), it is preferable that said wing is approximately formed in the shape of a flat plate, and upper and lower faces of this wing are formed in a streamline shape, and a front end portion of this wing is formed in the shape of a knife edge.

(8) In one of the above modes (1) to (7), it is preferable that said strut is approximately formed in the shape of a flat plate, and its side face is formed in a streamline shape, and front and rear end portions of the strut are formed in the shape of a knife edge.

(9) In one of the above modes (1) to (8), it is preferable that a vertical length of said strut can be adjusted.

(10) In a second embodiment mode of the present invention, the semi-submergence type hydrofoil craft comprises a water suction port opened to suck water from the front face of a craft body; a propeller for sending-out the water sucked from said water suction port backward; a water injection port opened to a rear face of said craft body so as to inject the water sent-out from said propeller backward; one water sending passage extending from the rear of said propeller to said water injection port; and at least one pair of wings projected from both side faces of said craft body.

Figure 1:
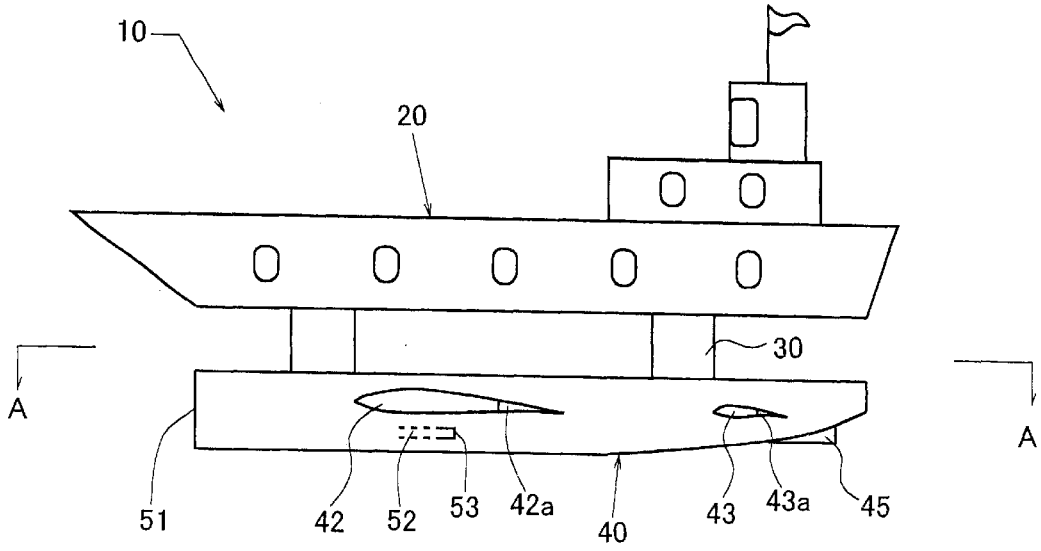
FIG. 1 is a schematic side view showing an embodiment mode of a hydrofoil craft in the present invention.

Each of FIGS. 2A and 2B is a schematic side view of an embodiment of a main wing of the hydrofoil craft of FIG. 1.

Figure 3:
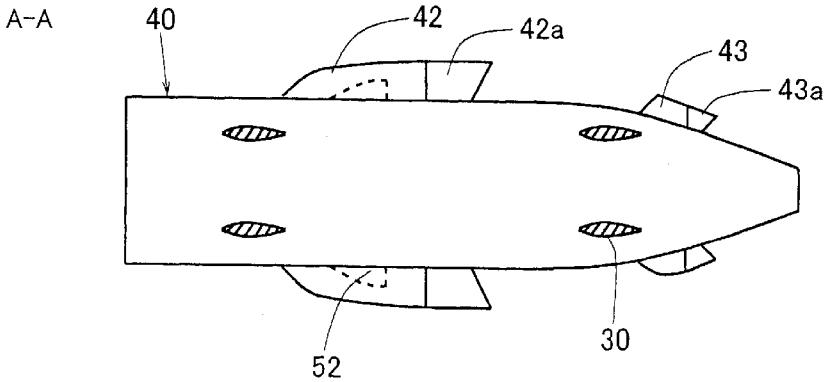

FIG. 3 is a schematic view showing an A-A section of the hydrofoil craft of FIG. 1.

Figure 4:
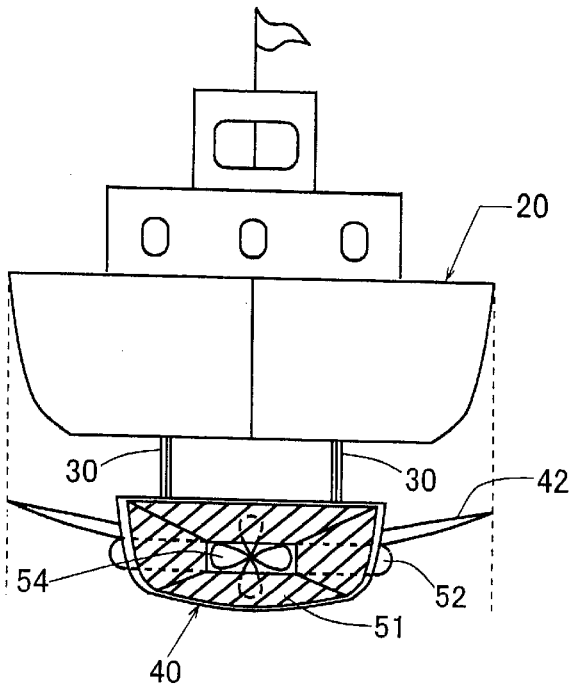

FIG. 4 is a front view of the hydrofoil craft of FIG. 1.

Figure 5:
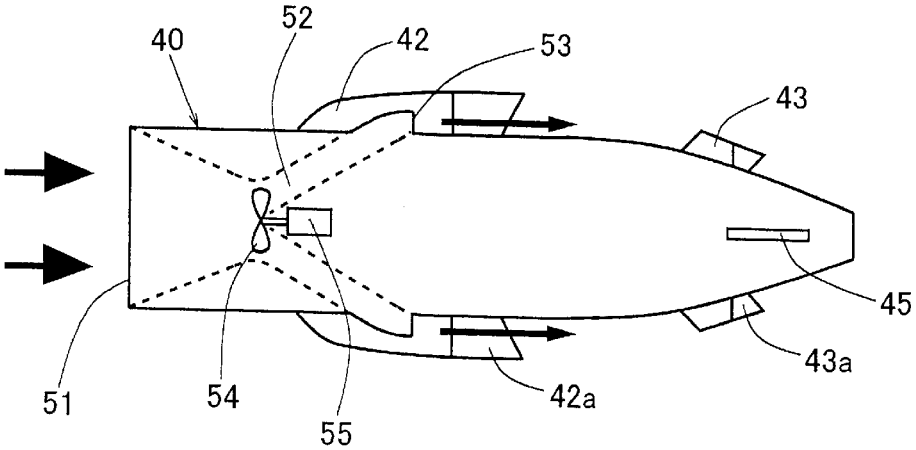

FIG. 5 is a-bottom view of the hydrofoil craft of FIG. 1, i.e., a bottom view of an underwater craft body.

Figure 6:
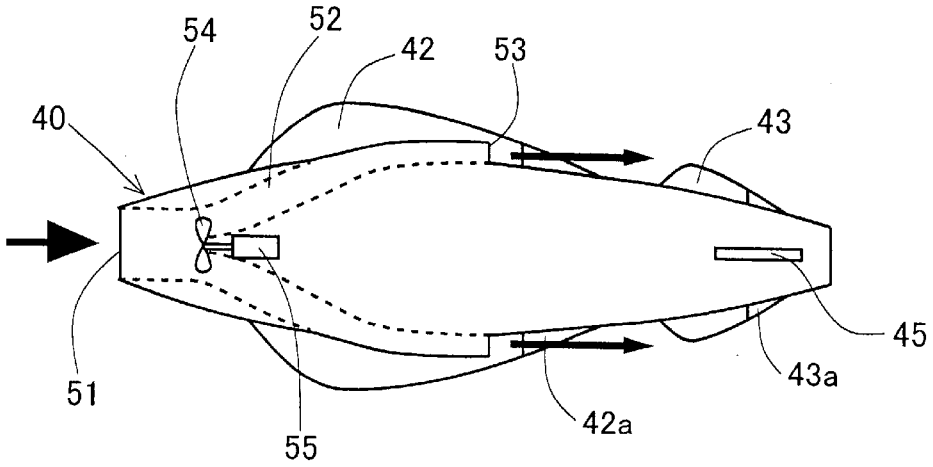

FIG. 6 is a bottom view showing another embodiment of the underwater craft body in the hydrofoil craft of the present invention, and similar to FIG. 5.

Figure 7:
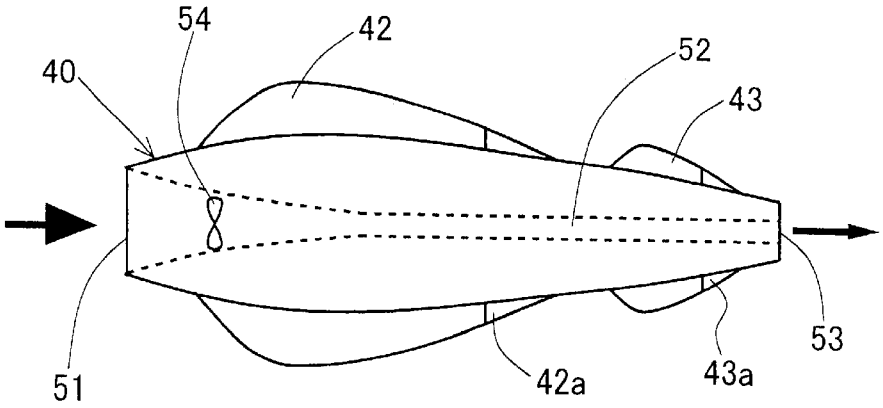

FIG. 7 is a bottom view showing still another embodiment of the underwater craft body in the hydrofoil craft of the present invention, and similar to FIG. 5.

DESCRIPTION OF THE PREFERRED EMBODIMENTS

The embodiment modes of the present invention will next be explained with reference to the drawings.

FIG. 1 is a schematic side view showing a first embodiment mode of a hydrofoil craft in the present invention. A craft main body of the hydrofoil craft 10 has a water surface craft body 20 floated upward from the water surface at a sailing time, an underwater craft body 40 sunk under the water surface, and a strut 30 vertically connecting the water surface craft body 20 and the underwater craft body 40. A cockpit, a cabin, etc. are arranged in the water surface craft body 20, and the underwater craft body 40 has a structure for generating propulsive power. In the hydrofoil craft 10 of the present invention, the water surface craft body 20 and the underwater craft body 40 are separated from each other, and the underwater craft body 40 is located under the water surface, i.e., is submerged at the sailing time. Accordingly, the hydrofoil craft 10 of the present invention is called "a semi-submergence type".

A pair of main wings 42 approximately formed in the shape of a flat plate and a pair of ailerons 43 are projected on both side faces of the underwater craft body 40. The ailerons 43 are normally smaller than the main wings 42 and are arranged behind the main wings 42. It is preferable to form upper and lower faces of the main wings 42 and the ailerons 43 in a streamline shape and form a front end portion as a knife-shaped edge to reduce water resistance. These members plays the roll of a balance adjustment, and stabilize the hydrofoil craft 10. A rudder 45 is arranged in a rear bottom portion of the underwater craft body 40 and controls a direction of the hydrofoil craft 10. As can be understood from the above explanation, it is also possible to suitably set the main wings and the ailerons to have the same size, and arrange the ailerons above or below the main wings.

The distance between the water surface craft body 20 and the underwater craft body 40 may be able to be adjusted by adjusting a vertical length of the strut 30 connecting the separated water surface craft body 20 and the underwater craft body 40. This is because the hydrofoil craft is sailed stably and safely by vertically adjusting this strut 30 in accordance with a water depth state.

Further, a pair of water injection ports 53 as the outlet of a water sending passage 52 extending through the craft body interior is arranged on both side faces of the underwater craft body 40. These water injection ports 53 are opened backward from the craft body to inject high pressure water providing propulsive force of the hydrofoil craft 10. The water injection ports 53 are preferably arranged below the above main wings 42. This is because buoyancy is given to the main wings 42 by the high pressure water injection.

Figure 2:
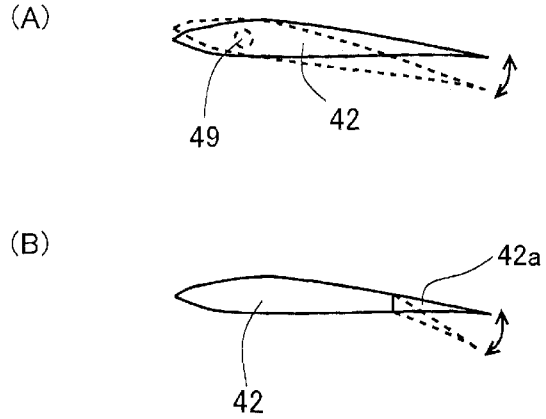

FIG. 2 is a schematic side view of the main wing 42. FIG. 2A shows a preferable example of the main wing 42, and the main wing 42 is formed in a streamline shape on its upper and lower faces, and its interior is set to a cavity. The buoyancy is secured by setting the interior to the cavity. As the craft body is large-sized, it is necessary to increase the cavity in size so as to obtain large buoyancy. Therefore, the main wing is designed that this main wing is increased in thickness and/or width to cope with this case. Further, the main wing 42 can be entirely rotated with a horizontal shaft 49 as a center. It is possible to secure stability at the sailing time and make a buoyancy adjustment and a speed adjustment by changing an angle with respect to a horizontal line by rotating the main wing 42. FIG. 2B shows another embodiment of the main wing 42 in which a flap 42*a* is attached to a rear end portion of the main wing 42. The flap 42*a* can be rotated with an attaching portion to the main wing 42 as a shaft. An action similar to that in the example of FIG. 2A is taken by this rotation. It is preferable to form upper and lower faces of the flap 42*a* in a streamline shape continuously connected to respective upper and lower streamline faces of the main wing 42 in a normal position, and form a rear end portion of the flap 42*a* in the shape of a knife edge so as to reduce water resistance. Operations of the main wing 42 of FIG. 2A an d the flap 42*a* of FIG. 2B can be controlled manually and/or automatically. These controls can be performed from a steering house (a cockpit). The aileron 43 may also have a structure similar to that of the main wing 42.

FIG. 3 is a schematic view showing an A—A section of FIG. 1. Four struts 30 connecting the underwater craft body 40 to the water surface craft body are arranged forward, backward, leftward and rightward in the illustrated example. In other examples, two struts can be arranged forward and backward, and one strut can be centrally arranged, etc. It is preferable that each strut 30 is entirely approximately formed in the shape of a flat plate, and its side face is formed in a streamline shape, and front and rear end portions of the strut 30 are formed in the shape of a knife edge so as to reduce wave making resistance by cutting waves at the sailing time.

FIG. 3 shows plane shapes of the main wings 42 on both side faces of the underwater craft body 40, the flap 42*a,* the aileron 43 and the flap 43*a*. These portions are shown as one example. Accordingly, for example, the flaps 42*a,* 43*a* can be also arranged in a state in which only portions of the flaps 42*a,* 43*a* are gradually separated from the underwater craft body 40. The main wing 42 and the aileron 43 may be also able to be respectively entirely rotated as in a preferable example in which no flaps 42*a,* 43*a* shown in FIG. 2A are arranged.

FIG. 4 is a front view of the hydrofoil craft 10 of FIG. 1. A water suction port 51 opened forward to a tip portion of the underwater craft body 40 extends backward from the opening, and a side face of the water suction port 51 is inclined and formed in a taper shape so as to gradually reduce its section (an oblique line portion). Further, a propeller 54 is fixed to a rear portion of the water suction port 51. The propeller 54 sends out backward water sucked from the water suction port 51. Since the water suction port 51 is formed in the taper shape, water sucked from the opening is compressed as this water is advanced backward within the water suction port 51. The compressed water is sent out further backward by the propeller 54 in a high pressure state. Thus, injection force, i.e., propulsive force is raised.

As shown in FIG. 4, the main wings 42 projected to both side faces of the underwater craft body 40 are set such that side ends of these main wings 42 have lengths not projected from side faces of the water surface craft body 20 so as not to make the main wings 42 run against a shore wall when the hydrofoil craft 10 reaches the shore. The same argument holds true too with respect to the aileron 43.

FIG. 5 is a bottom view of the hydrofoil craft 10 of FIG. 1, i.e., a bottom view of the underwater craft body 40. Thick arrows in FIG. 5 respectively show the direction of water sucked into the water suction port 51 and the direction of water injected from the water injection port 53. The propeller 54 is rotated by a suitable power source 55. Injection force of water, i.e., propulsive force can be adjusted by controlling the number of rotations of the propeller. The power source 55 is suitably constructed by an engine such as a steam turbine, a gas turbine, etc. able to obtain large power. In FIG. 5, the propeller 54 and the turbine 55 are drawn by solid lines to clarify the propeller 54 and the turbine 55, but are actually arranged within the underwater craft body 40 (are similarly arranged in the following drawings). A water sending passage 52 extends backward from a rear side of the propeller 54, and high pressure water sent out by the propeller is sent backward through the water sending passage 52. In the illustrated example, the water sending passage 52 is branched into two passages on left-hand and right-hand sides to inject the high pressure water from each of both side faces of the underwater craft body 40.

FIG. 6 is a bottom view showing another embodiment of the underwater craft body 40 in the hydrofoil craft of the present invention, and similar to FIG. 5. In this example, a side face of the water suction port 51 is not formed in a taper shape, but extends backward in the same section as it is.

FIG. 6 also shows another embodiment of plane shapes of the main wing 42 and the aileron 43. The main wing 42 and the aileron 43 can be formed in various shapes. It is not necessary to arrange the aileron 43 in accordance with the shape of the main wing 42. For example, it is not necessary to arrange the aileron if the main wing 42 is formed in a shape extending at a considerable length in forward and backward directions.

FIG. 7 is a bottom view showing still another embodiment of the underwater craft body 40 in the hydrofoil craft of the present invention, and similar to FIG. 5. In this example, only one water sending passage 52 is arranged, and extends on a straight line toward the rear side of the propeller 54, and a water injection port 53 opened to a rear face of the underwater craft body 40 is arranged. In comparison with the water sending passage 52 of a branch type shown in FIGS. 5 and 6, the water sending passage 52 in this embodiment is simple in structure and is applied to a compact craft not requiring large propulsive force.

Further, another embodiment mode of the present invention will be explained with reference to FIG. 7. The compact craft may be also set to have one craft body instead of a structure in which the underwater craft body 40 and the water surface craft body 20 are separated from each other as shown in FIG. 1. In this case, a bottom view of such a craft body is shown similarly to FIG. 7. Namely, the water suction port 51 is arranged on the front face of a craft body lower half portion, and the water injection port 53 is arranged on a rear face of the craft body lower half portion. Water sucked from the water suction port is sent out backward by the propeller 54, and is injected from the water injection port 53 on the rear face through the water sending passage 52. The main wings, etc. are projected to both side faces of the craft body lower half portion. The cockpit and the cabin are arranged in a craft body upper half portion.

In the underwater craft body 40 shown in FIGS. 5 to 7, the flaps 42*a,* 43*a* are respectively shown in the main wing 42 and the aileron 43, but the main wing 42 and the aileron 43 may be also set to be respectively entirely rotatable as in a preferable example in which no flaps 42*a,* 43*a* shown in FIG. 2A are arranged.

In the embodiments of the present invention shown above, wave making resistance is reduced to about 1/10 in comparison with normal shipping so that average speed per hour 40 km/h and maximum speed per hour 100 km/h (about 20 km/h in the normal shipping) can be realized.

As mentioned above, in the preferable embodiment modes of the hydrofoil craft of the semi-submergence type in the present invention, the water surface craft body and the underwater craft body connected by the strut are arranged, and the hydrofoil craft sails by sucking water from the water suction port on a front face of the underwater craft body, and injecting the high pressure water from both side faces of the underwater craft body or its rear face. The strut connecting the water surface craft body and the underwater craft body receives wave resistance at a sailing time, but the wave making resistance is reduced since the strut has a knife-shaped edge and a streamline shape side face. Further, the water resistance is also reduced and entire stability is also secured by the main wing arranged on a side face of the underwater craft body, etc.

Swinging of the water surface craft body is reduced by separating the water surface craft body and the underwater craft body. Further, a propulsive power source such as a turbine, etc. is arranged in the underwater craft body, but is separated from the underwater craft body by the strut. Therefore, no noises are easily transmitted to the water surface craft body. Accordingly, a comfortable environment in the water surface craft body is realized.

What is claimed is:

1. A semi-submergence type hydrofoil craft having a craft main body having a water surface craft body located above the water surface at a sailing time, an underwater craft body located below the water surface, and at least one strut vertically connecting said water surface craft body and said underwater craft body, said underwater craft body comprising:

a) a water suction port opened to suck water from a front face of said underwater craft body;

b) a propeller for sending out the water sucked from said water suction port backward;

c) at least one water injection port opened to inject the water sent out from said propeller backward;

d) at least one water sending passage extending from the rear of said propeller to said at least one water injection port; and e) at least one pair of wings projected from both side faces of said underwater craft body.

2. A semi-submergence type hydrofoil craft as defined in claim 1, wherein the at least one water injection port includes a pair of water injection ports, the pair of said water injection ports is opened to both the side faces of said underwater craft body, and two water sending passages are extended to the respective one of the pair of water injection ports leftward and rightward.

3. A semi-submergence type hydrofoil craft as defined in claim 2, wherein said pair of water injection ports is arranged below one of said at least one pair of wings on the side faces of said underwater craft body.

4. A semi-submergence type hydrofoil craft as defined in claim 2, wherein said water suction port is formed such that said water suction port is gradually reduced in section from its opening in a backward direction.

5. A semi-submergence type hydrofoil craft as defined in claim 2, wherein a rotatable flap attached to a rear end portion of said at least one pair of wings is arranged.

6. A semi-submergence type hydrofoil craft as defined in claim 2, wherein one of said at least one pair of wings is constructed by a main wing and an aileron arranged in forward and backward directions.

7. A semi-submergence type hydrofoil craft as defined in claim 2, wherein one of said at least one pair of wings is approximately formed in the shape of a flat plate, and upper and lower faces of this wing are formed in a streamline shape, and a front end portion of this wing is formed in the shape of a knife edge.

8. A semi-submergence type hydrofoil craft as defined in claim 2, wherein said at least one strut is approximately formed in the shape of a flat plate, and its side face is formed in a streamline shape, and front and rear end portions of the at least one strut are formed in the shape of a knife edge.

9. A semi-submergence type hydrofoil craft as defined in claim 2, wherein a vertical length of said at least one strut can be adjusted.

10. A semi-submergence type hydrofoil craft as defined in claim 1, wherein said water suction port is formed such that said water suction port is gradually reduced in section from its opening in a backward direction.

11. A semi-submergence type hydrofoil craft as defined in claim 1, wherein a rotatable flap attached to a rear end portion of one of said at least one pair of wings is arranged.

12. A semi-submergence type hydrofoil craft as defined in claim 1, wherein one of said at least one pair of wings is constructed by a main wing and an aileron arranged in forward and backward directions.

13. A semi-submergence type hydrofoil craft as defined in claim 1, wherein one of said at least one pair of wings is approximately formed in the shape of a flat plate, and upper and lower faces of this wing are formed in a streamline shape, and a front end portion of this wing is formed in the shape of a knife edge.

14. A semi-submergence type hydrofoil craft as defined in claim 1, wherein said at least one strut is approximately formed in the shape of a flat plate, and its side face is formed in a streamline shape, and front and rear end portions of the at least one strut are formed in the shape of a knife edge.

15. A semi-submergence type hydrofoil craft as defined in claim 1, wherein a vertical length of said at least one strut can be adjusted.

* * * * *